US011262675B2

(12) United States Patent
Takahashi et al.

(10) Patent No.: US 11,262,675 B2
(45) Date of Patent: Mar. 1, 2022

(54) IMAGE FORMING APPARATUS

(71) Applicant: FUJIFILM Business Innovation Corp., Tokyo (JP)

(72) Inventors: Masaaki Takahashi, Kanagawa (JP); Yoko Miyamoto, Kanagawa (JP); Noboru Hirakawa, Kanagawa (JP); Yoshiyuki Tominaga, Kanagawa (JP)

(73) Assignee: FUJIFILM Business Innovation Corp, Tokyo (JP)

( * ) Notice: Subject to any disclaimer, the term of this patent is extended or adjusted under 35 U.S.C. 154(b) by 143 days.

(21) Appl. No.: 16/290,972

(22) Filed: Mar. 4, 2019

(65) Prior Publication Data

US 2020/0026225 A1 Jan. 23, 2020

(30) Foreign Application Priority Data

Jul. 20, 2018 (JP) ..... JP2018-137065

(51) Int. Cl.
*G03G 15/16* (2006.01)
*G03G 15/00* (2006.01)

(52) U.S. Cl.
CPC ..... *G03G 15/1695* (2013.01); *G03G 15/5029* (2013.01)

(58) Field of Classification Search
CPC ..... G03G 15/1695
USPC ..... 399/390
See application file for complete search history.

(56) References Cited

U.S. PATENT DOCUMENTS

| | | | | |
|---|---|---|---|---|
| 8,472,859 | B2 * | 6/2013 | Kougami | G03G 15/6573 399/407 |
| 8,849,170 | B2 * | 9/2014 | Priebe | G03G 15/2053 399/335 |
| 8,971,784 | B2 * | 3/2015 | Endo | G03G 15/6576 399/341 |
| 10,197,951 | B2 * | 2/2019 | Sakurai | B65H 23/044 |
| 2006/0201236 | A1 * | 9/2006 | Taira | G01N 33/346 73/73 |
| 2011/0275015 | A1 * | 11/2011 | Nagao | G03G 15/2096 430/30 |
| 2014/0079458 | A1 * | 3/2014 | Seto | G01N 19/10 399/389 |
| 2017/0329263 | A1 * | 11/2017 | Sugiura | G03G 15/1605 |
| 2018/0253039 | A1 * | 9/2018 | Kakehi | G03G 15/5029 |

FOREIGN PATENT DOCUMENTS

| | | |
|---|---|---|
| JP | 2005-164919 | 6/2005 |
| JP | 2008-065025 | 3/2008 |
| JP | 2016-080756 | 5/2016 |

* cited by examiner

*Primary Examiner* — Anthony H Nguyen
(74) *Attorney, Agent, or Firm* — JCIPRNET

(57) ABSTRACT

An image forming apparatus includes an image holding unit that holds a toner image, a transfer unit that transfers the toner image held by the image holding unit onto a medium in a transfer region, a reduction unit that is positioned further upstream than the transfer region and that reduces an electrical resistance of a first surface of the medium, the first surface being opposite to a second surface of the medium onto which an image is to be transferred, and a control unit that controls the reduction unit in accordance with a type of a medium to be used in such a manner that the electrical resistance of the first surface does not exceed a predetermined range.

7 Claims, 10 Drawing Sheets

FIG. 8

| NAME OF SHEET | TYPE | BASIS WEIGHT | THICKNESS | DENSITY | SMOOTHNESS | AIR PERMEABILITY | SURFACE RESISTIVITY | VOLUME RESISTIVITY | WATER CONTENT | | | | | | |
|---|---|---|---|---|---|---|---|---|---|---|---|---|---|---|---|
| | | $g/m^2$ | μm | $g/m^3$ | sec | sec | Log Ω/□ | Log Ω·cm | 3-4 % | 4-5 % | 5-6 % | 6-7 % | 7-8 % | 8-9 % | 9-10 % |
| LEATHAC 66 | EMBOSSED PAPER | 204 | 221 | 0.91 | 0 | 334 | 10.7 | 11.8 | POOR | POOR | POOR | GOOD | GOOD | POOR | POOR |
| MERMAID SNOW WHITE | EMBOSSED PAPER | 186 | 265 | 0.63 | 0 | 23 | 9.8 | 10.7 | POOR | POOR | GOOD | GOOD | POOR | POOR | POOR |
| PANSION | JAPANESE PAPER | 90 | 176 | 0.5 | 3 | 2 | 11.9 | 12.6 | POOR | POOR | POOR | GOOD | GOOD | GOOD | POOR |
| J PAPER | WOOD-FREE PAPER | 80 | 86 | 0.8 | 92 | 15 | 10.6 | 11.4 | POOR | GOOD | GOOD | GOOD | POOR | POOR | POOR |

GOOD, POOR: IMAGE QUALITY EVALUATION

IMAGE FORMING APPARATUS

CROSS-REFERENCE TO RELATED APPLICATIONS

This application is based on and claims priority under 35 USC 119 from Japanese Patent Application No. 2018-137065 filed Jul. 20, 2018.

BACKGROUND

(i) Technical Field

The present disclosure relates to an image forming apparatus.

(ii) Related Art

As a technology for moisturizing a medium onto which an image is formed in an image forming apparatus, such as a copying machine or a printer, of the related art, the technologies described in Japanese Unexamined Patent Application Publication No. 2008-065025 ([0024] to [0032], [0042] to [0062], FIG. 5, FIG. 7, FIG. 9), which will be referred to as "Patent Document 1", Japanese Unexamined Patent Application Publication No. 2016-080756 ([0025] to [0037]) which will be referred to as "Patent Document 2", and Japanese Unexamined Patent Application Publication No. 2005-164919 ([0033] to [0043]), which will be referred to as "Patent Document 3", are commonly known.

Patent Document 1 describes a technology for supplying atomized water from the moisturizing unit (103) to a recording medium (P) in such a manner as to obtain an optimum transfer voltage by using the environmental temperature, the environmental humidity, the thickness of the recording medium (P), and the volume resistivity of the recording medium (P). Patent Document 1 also describes a configuration in which atomized water is supplied to a surface of the recording medium (P) onto which an image is transferred and in which water is applied to a surface of the recording medium (P) onto which an image is not transferred.

Patent Document 2 describes a technology for reducing the rigidity of burrs of a sheet (P) by moisturizing a surface (Pb) of the sheet (P) onto which an image is not formed by using a spray unit (52) before image formation is performed so as to suppress an increase in the torque of a driving roller for use in sheet transportation.

Patent Document 3 describes a technology for supplying water to a hydrophilic roller (102), which nips and transports a transfer member together with a hydrophobic roller (101) on the upstream side of a transfer region, by using a water-supply felt member (103) and applying water to a non-image surface of the transfer member in such a manner that the water content of a sheet, which is the transfer member, is set to about 4%.

SUMMARY

Aspects of non-limiting embodiments of the present disclosure relate to suppressing excessive or deficient adjustment of the electric resistance of a medium compared with a case where a medium is uniformly moisturized.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image holding unit that holds a toner image, a transfer unit that transfers the toner image held by the image holding unit onto a medium in a transfer region, a reduction unit that is positioned further upstream than the transfer region and that reduces an electrical resistance of a first surface of the medium, the first surface being opposite to a second surface of the medium onto which an image is to be transferred, and a control unit that controls the reduction unit in accordance with a type of a medium to be used in such a manner that the electrical resistance of the first surface does not exceed a predetermined range.

BRIEF DESCRIPTION OF THE DRAWINGS

Exemplary embodiments of the present disclosure will be described in detail based on the following figures, wherein:

FIG. 8 is a table illustrating Examples 1 to 4;

DETAILED DESCRIPTION

Figure 1:
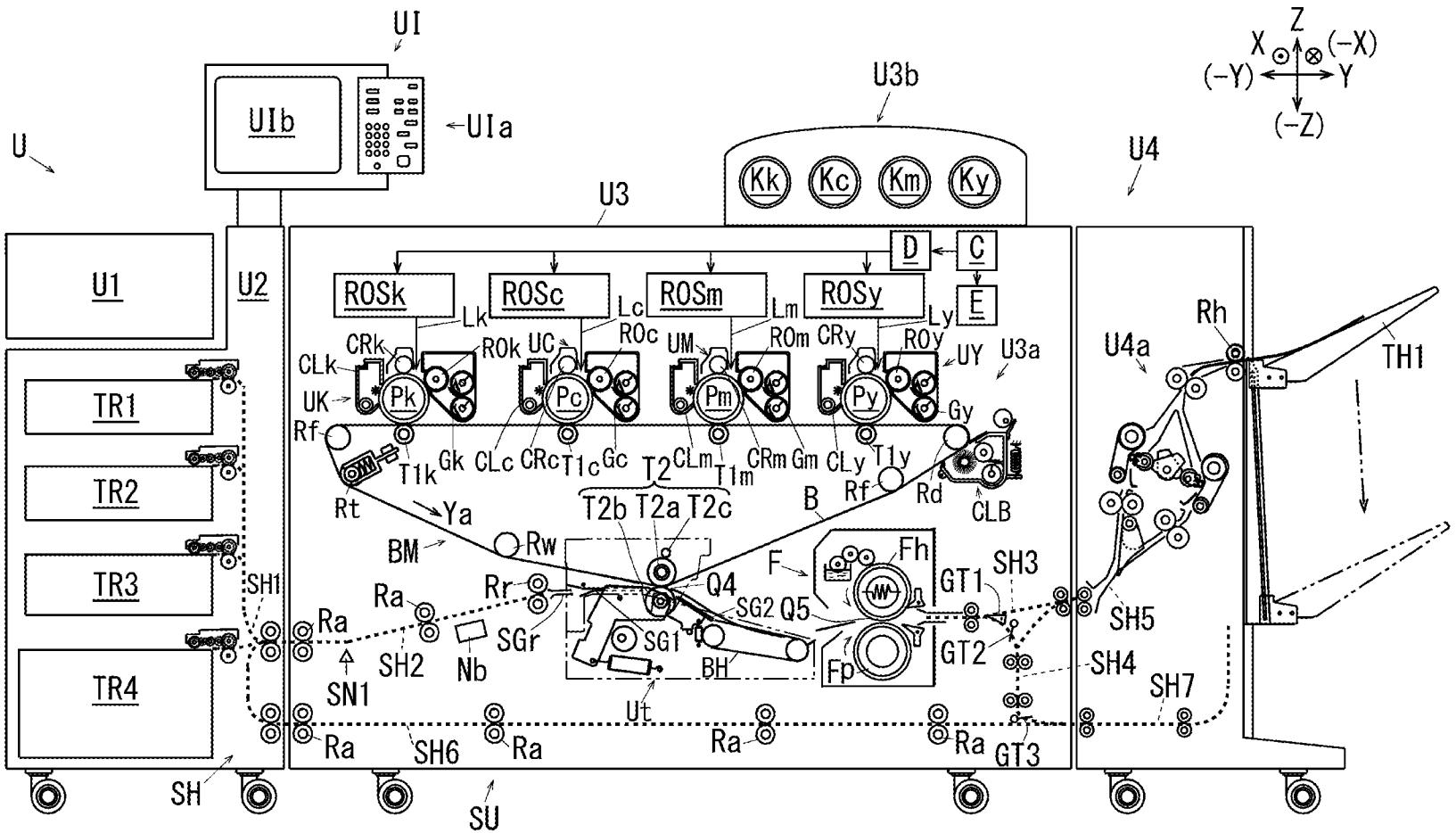
FIG. 1 is an overall view of an image forming apparatus according to a first exemplary embodiment of the present disclosure.

Although exemplary embodiments of the present disclosure will be described below as specific examples with reference to the drawings, the present disclosure is not limited to the following exemplary embodiments.

For ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or a front side, a rear side, a right side, a left side, a top side, and a bottom side.

An arrow extending from the rear side to the front side in the drawings is denoted by an encircled dot, and an arrow extending from the front side to the rear side in the drawings is denoted by an encircled cross.

In the following description, which refers to the drawings, descriptions of components that are not necessarily illustrated are suitably omitted for ease of understanding.

First Exemplary Embodiment

FIG. 1 is an overall view of an image forming apparatus according to a first exemplary embodiment.

Figure 2:
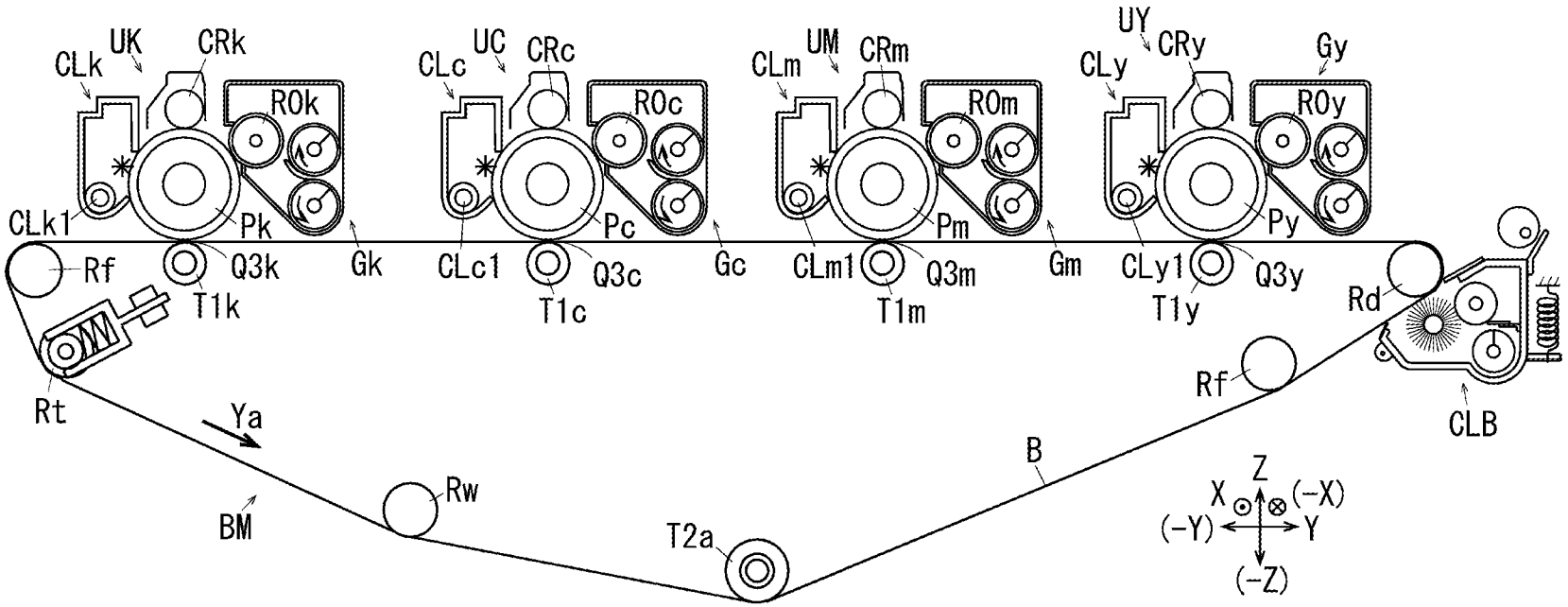
FIG. 2 is an enlarged view of visible-image forming devices according to the first exemplary embodiment.

FIG. 2 is an enlarged view of visible-image forming devices according to the first exemplary embodiment.

In FIG. 1, a copying machine U, which is an example of an image forming apparatus, includes an operation unit UI, a scanner unit U1, which is an example of an image reading device, a feeder unit U2, which is an example of a media-supply device, an image forming unit U3, which is an example of an image recording device, and a media processing device U4.

(Description of Operation Unit UI)

The operation unit UI includes input buttons UIa that are used for starting a copying operation, setting the number of sheets to be copied, and so forth. The operation unit UI further includes a display UIb that displays the contents input through the input buttons UIa and the state of the copying machine U.

(Description of Feeder Unit U2)

In FIG. 1, the feeder unit U2 includes a plurality of sheet-feeding trays TR1, TR2, TR3, and TR4, each of which is an example of a media container. The feeder unit U2 further includes a media supply path SH1, and recording sheets S, each of which is an example of an image recording medium and each of which is accommodated in one of the sheet-feeding trays TR1 to TR4, are taken out and transported along the media supply path SH1 to the image forming unit U3.

(Description of Image Forming Unit U3 and Media Processing Device U4)

In FIG. 1, the image forming unit U3 includes an image recording unit U3*a* that performs, on the basis of a document image read by the scanner unit U1, an image recording operation on one of the recording sheets S transported by the feeder unit U2.

In FIG. 1 and FIG. 2, a driving circuit D of latent-image forming devices ROSy, ROSm, ROSc, and ROSk outputs, at a predetermined timing, driving signals to the latent-image forming devices ROSy to ROSk on the basis of image information input thereto from the scanner unit U1. The latent-image forming devices ROSy, ROSm, ROSc, and ROSk are included in the image forming unit U3 and respectively correspond to colors of yellow (Y), magenta (M), cyan (C), and black (K). Photoconductor drums Py, Pm, Pc, and Pk, each of which is an example of an image holding unit, are disposed below the latent-image forming devices ROSy to ROSk.

Charging rollers CRy, CRm, CRc, and CRk, each of which is an example of a charging unit, charge surfaces of the photoconductor drums Py, Pm, Pc, and Pk, respectively. The latent-image forming devices ROSy, ROSm, ROSc, and ROSk, each of which is an example of a latent-image forming unit, output laser beams Ly, Lm, Lc, and Lk, each of which is an example of a latent-image writing light beam, so as to form electrostatic latent images onto the charged surfaces of the photoconductor drums Py to Pk. The electrostatic latent images formed on the surfaces of the photoconductor drums Py, Pm, Pc, and Pk are developed into toner images, which are examples of images of colors Y, M, C, and K, by developing devices Gy, Gm, Gc, and Gk, each of which is an example of a developing unit.

Note that the developing devices Gy to Gk are replenished with developers from toner cartridges Ky, Km, Kc, and Kk, each of which is an example of a developer container, after the developers have been used in a developing process. The toner cartridges Ky, Km, Kc, and Kk are detachably mounted on a developer replenishing device U3*b*.

The toner images formed on the surfaces of the photoconductor drums Py, Pm, Pc, and Pk are sequentially transferred onto an intermediate transfer belt B, which is an example of an image holding unit and an example of an intermediate transfer unit, in such a manner as to be superposed with one another by first transfer rollers T1*y*, T1*m*, T1*c*, and T1*k*, each of which is an example of a first transfer unit, in first transfer regions Q3*y*, Q3*m*, Q3*c*, and Q3*k*. Accordingly, a color toner image, which is an example of a multicolor visible image, is formed onto the intermediate transfer belt B. The color toner image formed on the intermediate transfer belt B is transported to a second transfer region Q4, which is an example of a final transfer region.

Note that, in the case where there is only image information of color K, only the photoconductor drum Pk and the developing device Gk, which correspond to color K, are used, and only a toner image of color K is formed.

After a first transfer operation has been performed, residues such as residual developer and paper dust deposited on the surfaces of the photoconductor drums Py, Pm, Pc, and Pk are removed by drum cleaners CLy, CLm, CLc, and CLk, each of which is an example of an image-carrier cleaning unit.

In the first exemplary embodiment, the photoconductor drum Pk, the charging roller CRk, the drum cleaner CLk are integrated with one another so as to form a photoconductor unit UK, which corresponds to color K and which is an example of an image carrier unit. Similarly, a photoconductor unit UY, which corresponds to color Y, includes the photoconductor drum Py, the charging roller CRy, and the drum cleaner CLy. A photoconductor unit UM, which corresponds to color M, includes the photoconductor drum Pm, the charging roller CRm, and the drum cleaner CLm. A photoconductor unit UC, which corresponds to color C, includes the photoconductor drum Pc, the charging roller CRc, and the drum cleaner CLc.

In addition, the photoconductor unit UK corresponding to color K and a developing device Gk that includes a developing roller R0*k*, which is an example of a developer holding unit, form a visible-image forming device UK+Gk, which corresponds to color K. Similarly, the photoconductor unit UY corresponding to color Y and a developing device Gy that includes a developing roller R0*y* form a visible-image forming device UY+Gy, which corresponds to color Y. The photoconductor unit UM corresponding to color M and a developing device Gm that includes a developing roller R0*m* form a visible-image forming device UM+Gm, which corresponds to color M. The photoconductor unit UC corresponding to color C and a developing device Gc that includes a developing roller R0*c* form a visible-image forming device UC+Gc, which corresponds to color C.

A belt module BM, which is an example of an intermediate transfer device, is disposed below the photoconductor drums Py to Pk. The belt module BM includes the intermediate transfer belt B, a driving roller Rd, which is an example of a driving member for an intermediate transfer body, a tension roller Rt, which is an example of a tension-applying member, a working roller Rw, which is an example of a member that prevents the intermediate transfer belt B from moving in a serpentine manner, a plurality of idle rollers Rf, each of which is an example of a driven member, a backup roller T2*a*, which is an example of an opposing member, and the above-mentioned first transfer rollers T1*y*, T1*m*, T1*c*, and T1*k*. The intermediate transfer belt B is supported in such a manner as to be rotatable in the direction of arrow Ya.

A second transfer unit Ut is disposed below the backup roller T2*a*. The second transfer unit Ut includes a second transfer roller T2*b*, which is an example of a second transfer unit. The second transfer region Q4 is formed of a region in which the second transfer roller T2*b* are in contact with the intermediate transfer belt B. The backup roller T2*a*, which is an example of an opposing member, faces the second transfer roller T2*b* with the intermediate transfer belt B interposed therebetween. A contact roller T2*c*, which is an example of a power supplying member, is in contact with the backup roller T2*a*. A second transfer voltage having a polarity that is the same as the charge polarity of a toner is applied to the contact roller T2*c*.

The backup roller T2*a*, the second transfer roller T2*b*, and the contact roller T2*c* form a second transfer unit T2, which is an example of a second transfer unit.

A media transport path SH2 is disposed below the belt module BM. One of the recording sheets S that has been fed along the media supply path SH1 of the feeder unit U2 is transported to a pair of registration rollers Rr, each of which is an example of a member that adjusts the timing of transportation, by transport rollers Ra each of which is an example of a media transport member. The pair of registration rollers Rr transport the recording sheet S toward a downstream side in accordance with the timing at which a toner image that has been formed on the intermediate transfer belt B is transported to the second transfer region Q4. The recording sheet S, which has been sent out by the pair of registration rollers Rr, is guided by a sheet guide SGr, which is disposed on the side on which the pair of registration rollers Rr are disposed, and a pre-transfer sheet guide SG1 in such a manner as to be transported to the second transfer region Q4.

The toner image on the intermediate transfer belt B is transferred onto the recording sheet S by the second transfer unit T2 when the toner image passes through the second transfer region Q4. Note that, in the case of a color toner image, toner images that have been transferred in a first transfer process to a surface of the intermediate transfer belt B in such a manner as to be superposed with one another are collectively transferred in a second transfer process onto the recording sheet S.

The first transfer rollers T1*y* to T1*k*, the second transfer unit T2, and the intermediate transfer belt B form a transfer device T1*y*-to-T1*k*+T2+B according to the first exemplary embodiment, which is an example of a transfer unit.

A belt cleaner CLB, which is an example of a cleaning unit for an intermediate transfer body, is disposed downstream from the second transfer region Q4 in such a manner as to be positioned along a portion of the intermediate transfer belt B that has been used in the second transfer process. In the second transfer region Q4, the belt cleaner CLB cleans the intermediate transfer belt B by removing residues such as residual developer and paper dust that have not transferred and remain on the intermediate transfer belt B.

One of the recording sheets S to which a toner image has been transferred is guided by a post-transfer sheet guide SG2 and sent to a media transport belt BH, which is an example of a transport member. The media transport belt BH transports the recording sheet S to a fixing device F.

The fixing device F, which is an example of a fixing unit, includes a heating roller Fh, which is an example of a heating member, and a pressure roller Fp, which is an example of a pressing member. The recording sheet S is transported to a fixing region Q5, which is a region in which the heating roller Fh and the pressure roller Fp are in contact with each other. When the recording sheet S passes through the fixing region Q5, the fixing device F applies heat and pressure to the toner image on the recording sheet S, and as a result, the toner image is fixed onto the recording sheet S.

The visible-image forming devices UY+Gy to UK+Gk, the transfer device T1*y*-to-T1*k*+T2+B, and the fixing device F form the image recording unit U3*a* according to the first exemplary embodiment.

A switching gate GT1, which is an example of a switching member, is disposed downstream from the fixing device F. The switching gate GT1 selectively switches between an ejection path SH3, which is disposed on the side on which the media processing device U4 is disposed, and a reverse path SH4 in such a manner that one of the recording sheets S that has passed through the fixing region Q5 is transported along one of the ejection path SH3 and the reverse path SH4. The recording sheet S that has been transported to the ejection path SH3 is transported to a sheet transport path SH5 of the media-processing device U4. A curl correction member U4*a*, which is an example of a curvature correction member, is disposed on the sheet transport path SH5. The curl correction member U4*a* corrects the curvature, or specifically the curl, of the recording sheet S that has been transported to the transport path SH5. The recording sheet S whose curl has been corrected is ejected to an ejection tray TH1, which is an example of a media ejection unit, by a pair of ejection rollers Rh, each of which is an example of a media ejection member, in such a manner that a surface of the recording sheet S to which an image has been fixed (hereinafter referred to as an image fixed surface) faces upward.

One of the recording sheets S that has been transported by the switching gate GT1 to the side on which the reverse path SH4 of the image forming unit U3 is disposed passes through a second gate GT2, which is an example of a switching member, and is transported to the reverse path SH4 of the image forming unit U3.

In this case, in the case of ejecting the recording sheet S in such a manner that the image fixed surface of the recording sheet S faces downward, after a trailing end of the recording sheet S in the transport direction has passed through the second gate GT2, the transport direction of the recording sheet S is reversed. Here, the second gate GT2 according to the first exemplary embodiment is formed of a thin-film-shaped elastic member. Accordingly, the second gate GT2 allows the recording sheet S, which has been transported to the reverse path SH4, to pass therethrough once. After passing through the second gate GT2, the recording sheet S is flipped over, or specifically switched back, and then the second gate GT2 guides the recording sheet S to the side on which the transport paths SH3 and SH5 are disposed. Subsequently, the recording sheet S, which has been switched back, passes through the curl correction member U4*a* and is ejected to the ejection tray TH1 in a state where the image fixed surface of the recording sheet S faces downward.

A circulation path SH6 is connected to the reverse path SH4 of the image forming unit U3, and a third gate GT3, which is an example of a switching member, is disposed at a portion in which the reverse path SH4 and the circulation path SH6 are connected to each other. A downstream end of the reverse path SH4 is connected to a reverse path SH7 of the media-processing device U4.

One of the recording sheets S that has been transported to the reverse path SH4 through the switching gate GT1 is transported to the side on which the reverse path SH7 of the media-processing device U4 is disposed by the third gate GT3. Similar to the second gate GT2, the third gate GT3 according to the first exemplary embodiment is formed of a thin-film-shaped elastic member. Accordingly, the third gate GT3 allows the recording sheet S, which has been transported along the reverse path SH4, to pass therethrough once. After passing through the third gate GT3, the recording sheet S is switched back, and then the third gate GT3 guides the recording sheet S to the side on which the circulation path SH6 is disposed.

The recording sheet S that has been transported to the circulation path SH6 is sent to the second transfer region Q4 again through the media transport path SH2, and a printing operation is performed on a second surface of the recording sheet S, the second surface being opposite to the image fixed surface of the recording sheet S.

The above-described components that are denoted by the reference signs SH1 to SH7 form a sheet transport path SH. The above-described components that are denoted by the reference signs SH, Ra, Rr, Rh, SGr, SG1, SG2, BH, and GT1 to GT3 form a sheet transport device SU according to the first exemplary embodiment.

(Description of Reduction Unit)

A moisture meter SN1, which is an example of a detection unit, is disposed on the media transport path SH2 in such a manner as to be positioned further upstream than the pair of registration rollers Rr. A non-contact type moisture meter that measures the water content of one of the recording sheets S, which passes thereby, without coming into contact with the recording sheet S may be used as the moisture meter SN1 according to the first exemplary embodiment, or a contact type moisture meter that measures the water content of one of the recording sheets S by coming into contact with the recording sheet S may be used as the moisture meter SN1. An example of a non-contact type moisture meter is a moisture meter that measures the water content of one of the recording sheets S from reflected light, which is infrared rays radiated to and reflected by the recording sheet S, on the basis of the absorption rate of infrared rays (an example of electromagnetic waves) that are radiated onto the recording sheet S varying in accordance with the water content of the recording sheet S. Alternatively, a non-contact moisture meter that measures the water content of one of the recording sheets S on the basis of the transmittance of microwaves, which is an example of electromagnetic waves, varying in accordance with the water content of the recording sheet S.

Note that, as a contact type moisture meter, a moisture meter may be used that measures the water content of one of the recording sheets S by bringing a plurality of electrode members into contact with the recording sheet S on the basis of electrical resistance and electric capacity varying in accordance with the water content of the recording sheet S.

The method of detecting water content is not limited to a method using a moisture meter. For example, the relationship between the water content of a sheet and the weight of the sheet may be measured beforehand for each type of sheet to be used. Then, the weight of one of the recording sheets S that passes by may be measured, and the water content of the recording sheet S may be derived from the measured weight.

Alternatively, the water content of one of the recording sheets S may be determined by estimating the water content of the recording sheet S from the time course (history) of the humidity and the period of time during which the recording sheet S has not been used.

Although it is desirable that the water content be automatically detected by a sensor such as the moisture meter SN1, a user may input the water content of one of the recording sheets S to be used by using the operation unit UI, so that the water content of the recording sheet S may be manually determined.

A spray device Nb, which is an example of a reduction unit and an example of a moisturizing unit, is disposed at a position downstream from the moisture meter SN1 and upstream from the pair of registration rollers Rr. The spray device Nb is disposed so as to face the rear surface of one of the recording sheets S, that is, a non-transfer surface of the recording sheet S that is opposite to a surface of the recording sheet S onto which an image is transferred in the second transfer region Q4. The spray device Nb is configured in a similar manner to an ink jet head and ejects water instead of an ink. Note that, in the first exemplary embodiment, distilled water in which a surface-active agent is mixed is used in such a manner that an ink jet nozzle (a spout) will not become clogged.

The spray device Nb according to the first exemplary embodiment is disposed in such a manner as to extend over the entire area of one of the recording sheets S in the width direction of the recording sheet S, and a large number of spouts are arranged in the width direction. Thus, the amount of water to be ejected (the amount and the number of liquid droplets) may be controlled by controlling the ink jet head.

Note that, although a configuration has been described as an example in which the ink jet head is disposed in such a manner as to extend over the entire area of one of the recording sheets S in the width direction of the recording sheet S, the present disclosure is not limited to this configuration. For example, a configuration in which one or more ink jet heads each having a length that is smaller than the width of one of the recording sheets S in the width direction are arranged and in which water is ejected while the ink jet heads are moving in the width direction may be employed.

Note that, although a moisturizing unit that moisturizes one of the recording sheets S by spraying water onto the recording sheet S has been described as an example of the spray device Nb, the spray device Nb is not limited to such a moisturizing unit. For example, as the fluid to be sprayed, a fluid, such as a liquid or a gas in which an electrically conductive material has been dispersed, that is capable of changing the electrical resistance of one of the recording sheets S by imparting electrical conductivity along a surface of the recording sheet S may be used instead of water. For example, a configuration in which a fluid such as an electrically conductive coating material is sprayed onto one of the recording sheets S may be employed. Accordingly, the present disclosure is not limited to moisturizing the recording sheets S, and the electrical resistances of the recording sheets S may be adjusted by spraying an electrically conductive material onto the recording sheets S. Note that the electrically conductive material may be colorless, or a colored conductive material may be used.

In addition, although an ink jet head has been described as an example of the spray device Nb, the spray device Nb is not limited to such an ink jet head. A spray device (a nebulizer) using an arbitrary method, such as a spray device that uses a high-frequency diaphragm, may be used.

(Description of Controller of First Exemplary Embodiment)

Figure 3:
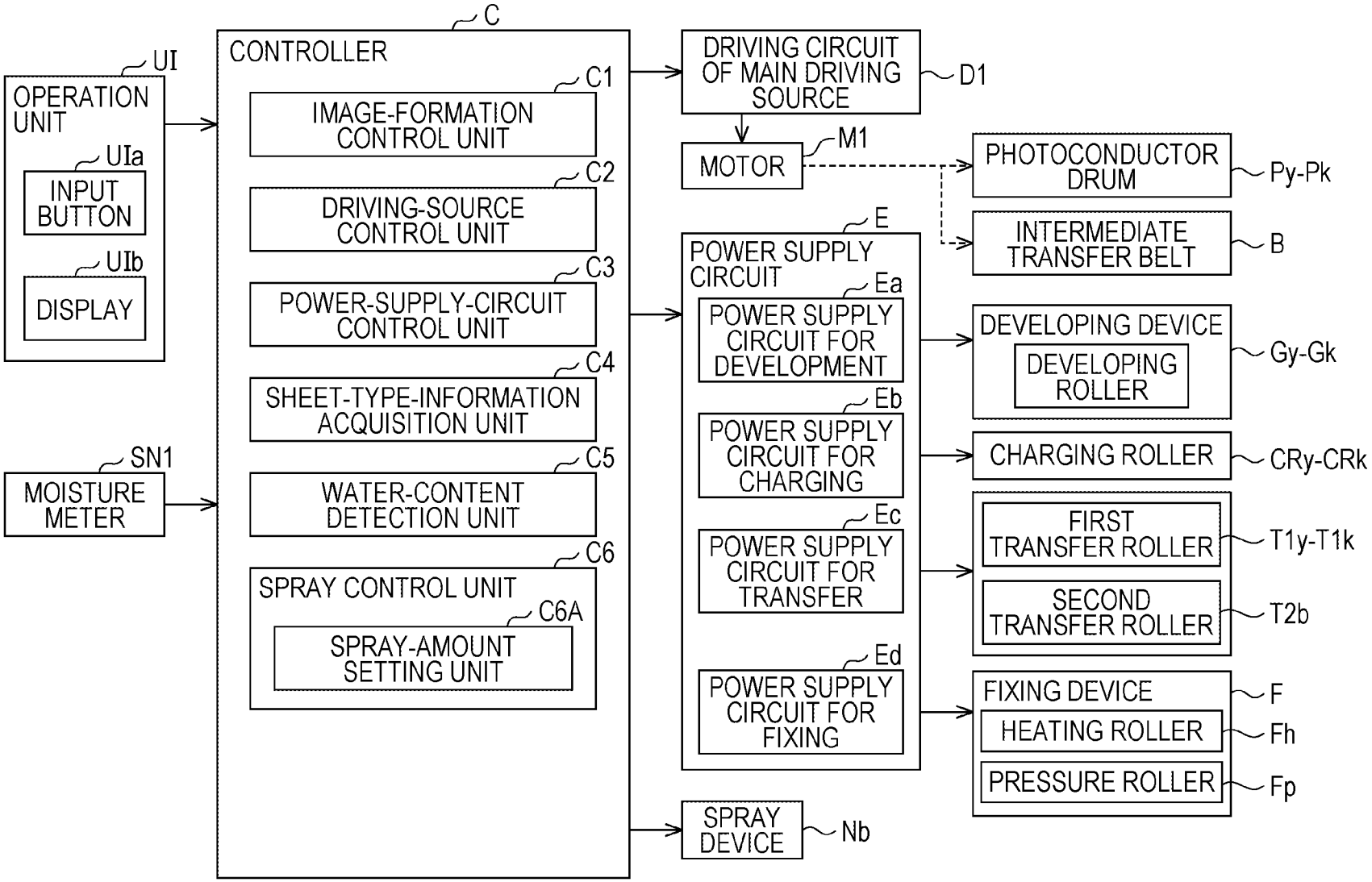
FIG. 3 is a block diagram illustrating functions of a controller of the image forming apparatus according to the first exemplary embodiment.

FIG. 3 is a block diagram illustrating functions of a controller of the image forming apparatus according to the first exemplary embodiment.

In FIG. 3, a controller C, which is an example of a control unit of the copying machine U, includes an input/output interface I/O that inputs and outputs signals to and from the outside. The controller C further includes read only memory (ROM) that stores programs for processing to be performed, information, and the like. The controller C further includes random access memory (RAM) that temporarily stores necessary data. The controller C further includes a central processing unit (CPU) that performs processing according to the programs stored in the ROM and the like. Thus, the controller C according to the first exemplary embodiment is formed of a small-sized information processing apparatus, or specifically a microcomputer. Accordingly, the controller C may realize various functions by executing the programs stored in the ROM and the like.

(Signal-Output Elements Connected to Controller C)

Output signals from signal-output elements such as the operation unit UI and the moisture meter SN1 are input to the controller C.

The operation unit UI includes the input buttons UIa including a copy start key, a numeric keypad, and arrow buttons each of which is an example of an input unit and each of which is used in an input operation.

The moisture meter SN1 detects the water contents of the recording sheets S.

(To-be-Controlled Element Connected to Controller C)

The controller C is connected to a driving circuit D1 of a driving source, a power-supply circuit E, and other control elements (not illustrated). The controller C outputs control signals to the circuits D1, E, and the like so as to control the circuits D1, E, and the like.

D1: Driving Circuit of Driving Source

The photoconductor drums Py to Pk, the intermediate transfer belt B, and so forth are driven so as to rotate by the driving circuit D1 of the driving source via a motor M1, which is an example of a driving source.

E: Power-Supply Circuit

The power-supply circuit E includes a power-supply circuit Ea for use in a developing process, a power-supply circuit Eb for use in a charging process, a power-supply circuit Ec for use in a transfer process, and a power-supply circuit Ed for use in a fixing process.

Ea: Power-Supply Circuit for Use in Developing Process

The power-supply circuit Ea for use in a developing process applies a developing voltage to the developing rollers of the developing devices Gy to Gk.

Eb: Power-Supply Circuit for Use in Charging Process

The power-supply circuit Eb for use in a charging process applies a charging voltage for charging the surfaces of the photoconductor drums Py to Pk to the charging rollers CRy to CRk.

Ec: Power-Supply Circuit for Use in Transfer Process

The power-supply circuit Ec for use in a transfer process applies a transfer voltage to the first transfer rollers T1*y* to T1*k* and the backup roller T2*a*.

Ed: Power-Supply Circuit for Use in Fixing Process

The power-supply circuit Ed for use in a fixing process supplies power to a heater of the heating roller Fh of the fixing device F.

(Functions of Controller C)

The controller C has a function of outputting control signals to the above-mentioned control elements by performing processing according to input signals from the above-mentioned signal-output elements. In other words, the controller C has the following functions.

C1: Image-Formation Control Unit

An image-formation control unit C1 controls, for example, driving of the members included in the scanner unit U1 and the members included in the image forming unit U3 and the timing of application of each voltage in accordance with the contents input to the operation unit UI and image information input from an external personal computer or the like and executes a job, which is an image forming operation.

C2: Driving-Source Control Unit

A driving-source control unit C2 controls driving of the motor M1 via the driving circuit D1 of the driving source and controls driving of the photoconductor drums Py to Pk and so forth.

C3: Power-Supply-Circuit Control Unit

A power-supply-circuit control unit C3 controls the power-supply circuits Ea to Ed so as to control the voltages to be applied to the members and the power to be supplied to each of the members.

C4: Sheet-Type-Information Acquisition Unit

A sheet-type-information acquisition unit C4, which is an example of an image-formation-condition acquisition unit, acquires, as an example of an image formation condition, a sheet type that is the type of one of the recording sheets S to be used when a job is executed. The sheet-type-information acquisition unit C4 according to the first exemplary embodiment acquires information regarding the type of a sheet to be used in a job on the basis of sheet-type information items that are registered beforehand to the sheet-feeding trays TR1 to TR4 and at least one of the sheet-feeding trays TR1 to TR4 to be used in the job. Note that, in the first exemplary embodiment, the sheet-type information items include information items regarding the types of media such as wood-free paper, recycled paper, an OHP film, each of which is an example of a medium not to be controlled, and media such as embossed paper and Japanese paper, each of which is an example of a medium to be controlled. Note that the sheet-type information items may include information items regarding the sizes of the recording sheets S (e.g., A4, A3, and B5) and information items regarding the basis weights of the recording sheets S that relate to the thicknesses of the recording sheets S (e.g., thin sheet, normal sheet, thick sheet, and extra thick sheet).

C5: Water-Content Detection Unit

A water-content detection unit C5 detects the water content of one of the recording sheets S on the basis of a detection result obtained by the moisture meter SN1. Note that, in the first exemplary embodiment, although detecting the water content of one of the recording sheets S indirectly corresponds to detecting the electric resistance of the recording sheet S, processing for deriving the electric resistance of the recording sheet S is not performed. In other words, although water content is used as a parameter in the first exemplary embodiment, the present disclosure is not limited to this case, and electrical resistance may be derived and used as a parameter.

Note that water content detection may be performed each time one of the recording sheets S passes by (for each of the recording sheets S) or may be performed at predetermined intervals (e.g., for every 100 recording sheets S). Alternatively, only the water content of one of the first recording sheets S that is the first sheet when a job is started may be detected, or one of the recording sheets S may be sent when the copying machine U is activated or at a predetermined time (e.g., 8:00 a.m.), and the water content of the recording sheet S may be detected. In the first exemplary embodiment, control is performed in such a manner that the water content of one of the first recording sheets S that is the first sheet when a job is started is detected.

C6: Spray Control Unit

A spray control unit C6 includes a spray-amount setting unit C6A and controls the spray device Nb in accordance with the type of a medium to be used such that the electric resistance of a non-transfer surface does not exceed a predetermined range. In the first exemplary embodiment, in the case where a medium to be used is embossed paper or Japanese paper, which is an example of the medium to be controlled, the spray device Nb is controlled in accordance with the water content of the medium. When the water content of a medium is low, the electrical resistance of the medium is likely to be high, and in the first exemplary embodiment, when the water content of a medium is low, the spray device Nb sprays water onto the medium so as to reduce the electrical resistance of the medium.

The spray control unit C6 according to the first exemplary embodiment causes the spray device Nb to operate when the electrical resistance that corresponds to the water content of one of the recording sheets S detected by the water-content detection unit C5 exceeds a range predetermined in accordance with the type of the recording sheet S. In the first exemplary embodiment, the predetermined range is set to "a water content of 6% to 7%" as an example, and when a detected water content falls below (or exceeds) this range, the spray device Nb is caused to operate. Thus, when a detected water content is within the range of 6% to 7% (does not exceed the range), the spray device Nb is not caused to operate. In the first exemplary embodiment, the spray device Nb is controlled so as not to operate also when a detected water content is 7% or higher. As a result, in the first exemplary embodiment, the spray device Nb operates when a detected water content is lower than 6%, and the spray device Nb does not operate when a detected water content reaches 6%.

C6A: Spray-Amount Setting Unit

The spray-amount setting unit C6A sets a spray amount in accordance with the water content of one of the recording sheets S, the spray amount being the amount of water that is sprayed by the spray device Nb. The spray-amount setting unit C6A according to the first exemplary embodiment sets the spray amount in such a manner that the water content of one of the recording sheets S after water has been sprayed on the recording sheet S is within a range of 6% to 7%. For example, in the case where the water content of one of the recording sheets S that has been detected is 3%, the water content needs to be supplemented with a water content of 3% by the spray device Nb in order to reach a target water content, which is 6% or higher (the difference between the detected water content and the target water content is 3%). In the case where the detected water content of the recording sheet S is 5%, the difference between the detected water content and the target water content is 1%. Consequently, in the first exemplary embodiment, in the case where the detected water content of the recording sheet S is 5%, the spray amount is set such that an amount of water equivalent to a water content of 1% is sprayed onto the recording sheet S by the ink jet head, and in the case where the detected water content of the recording sheet S is 3%, the spray amount is set such that an amount of water equivalent to a water content of 3%, is sprayed onto the recording sheet S by the ink jet head. Thus, the spray control unit C6 controls the spray device Nb such that the ink jet head sprays water by using all the spouts thereof when the spray amount is large and such that the ink jet head sprays water by using some of the spouts thereof when the spray amount is small.

(Description of Flowchart of First Exemplary Embodiment)

The flow of control in the copying machine U of the first exemplary embodiment will now be described by using a flowchart.

(Description of Flowchart of Processing for Controlling Resistance of Sheet)

Figure 4:
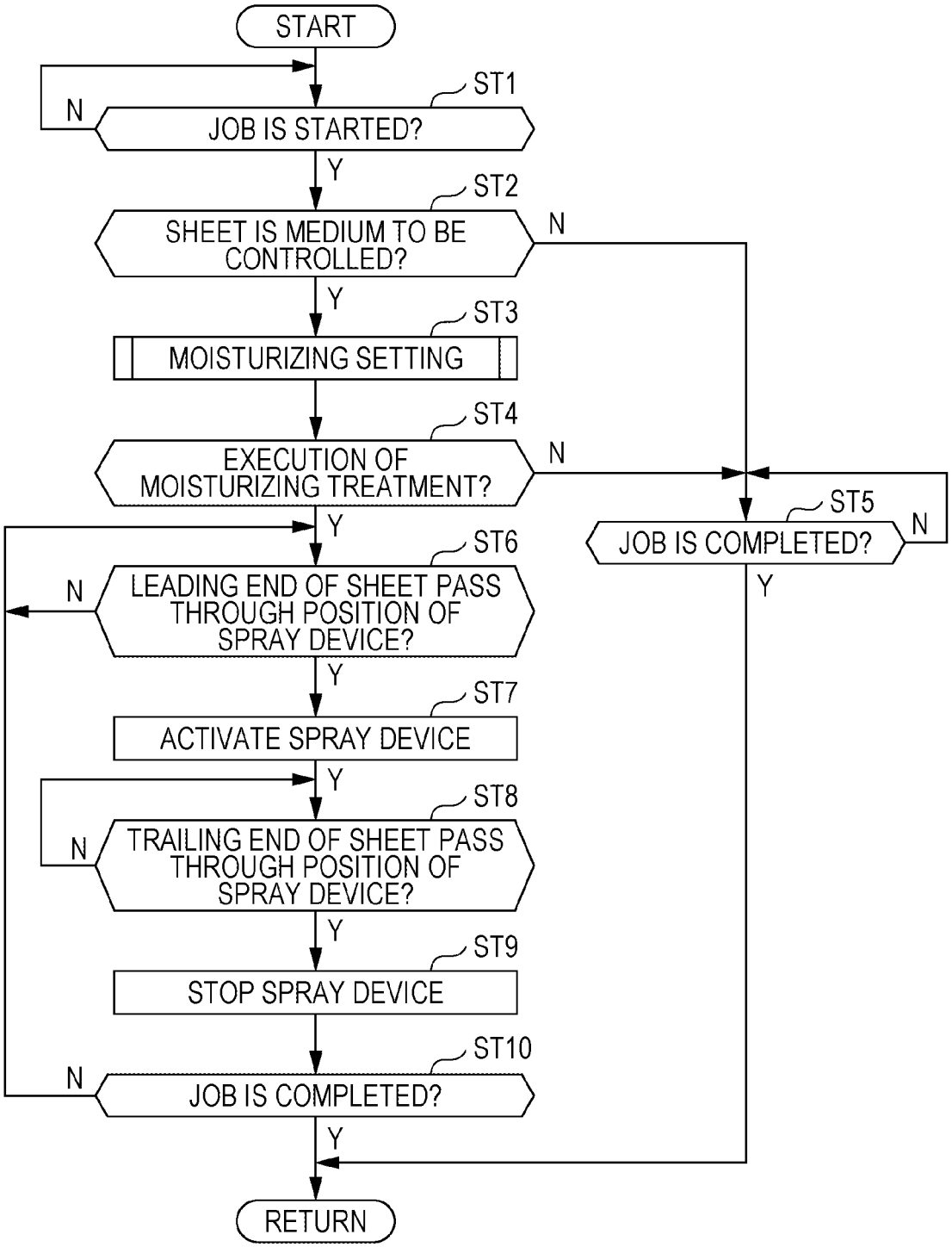
FIG. 4 is a flowchart of processing for controlling the resistance of a sheet according to the first exemplary embodiment.

FIG. 4 is a flowchart of processing for controlling the resistance of a sheet according to the first exemplary embodiment.

The processing of each step ST of the flowchart illustrated in FIG. 4 is performed in accordance with the programs stored in the controller C of the copying machine U. In addition, the processing of each step ST is performed in parallel with other various processing operations. Thus, processing for forming images onto the recording sheets S with start of a job is performed in parallel with the process illustrated by the flowchart in FIG. 4.

The process illustrated by the flowchart in FIG. 4 is started by switching on the copying machine U.

In step ST1 in FIG. 4, it is determined whether a job has been started. When the determination result is Yes (Y), the process continues to step ST2, and when the determination result is No (N), step ST1 is repeated.

In step ST2, it is determined whether the type of a sheet that is used in the job is the medium to be controlled. In other words, it is determined whether one of the recording sheets S to be used is embossed paper or Japanese paper. When the determination result is Yes (Y), the process continues to step ST3, and when the determination result is No (N), the process moves on to step ST5.

In step ST3, moisturizing setting processing in which enabling or disabling of moisturizing of the recording sheet S is set and in which the degree of moisturization (the spray amount) is set is performed, and the process continues to step ST4. Note that the moisturizing setting processing will be described later with reference to FIG. 5.

In step ST4, it is determined whether "execution of moisturizing treatment" is set. When the determination result is Yes (Y), the process moves to step ST6, and when the determination result is No (N), the process continues to step ST5.

In step ST5, it is determined whether the job is completed. When the determination result is Yes (Y), the process returns to step ST1, and when the determination result is No (N), step ST5 is repeated.

In step ST6, it is determined whether the timing at which a leading end of the recording sheet S passes by the position of the spray device Nb has come. When the determination result is Yes (Y), the process continues to step ST7, and when the determination result is No (N), step ST6 is repeated.

In step ST7, the spray device Nb is caused to operate. Note that, in this case, the spray device Nb is caused to operate in such a manner as to spray an amount of water equal to the spray amount that has been set in the moisturizing setting processing (step ST3). Then, the process continues to step ST8.

In step ST8, it is determined whether the timing at which a trailing end of the recording sheet S passes by the position of the spray device Nb has come. When the determination result is Yes (Y), the process continues to step ST9, and when the determination result is No (N), step ST8 is repeated.

In step ST9, the operation of the spray device Nb is stopped. Then, the process continues to step ST10.

In step ST10, it is determined whether the job is completed. When the determination result is No (N), the process returns to step ST6, and when the determination result is Yes (Y), the process returns to step ST1.

(Description of Flowchart of Moisturizing Setting Processing)

Figure 5:
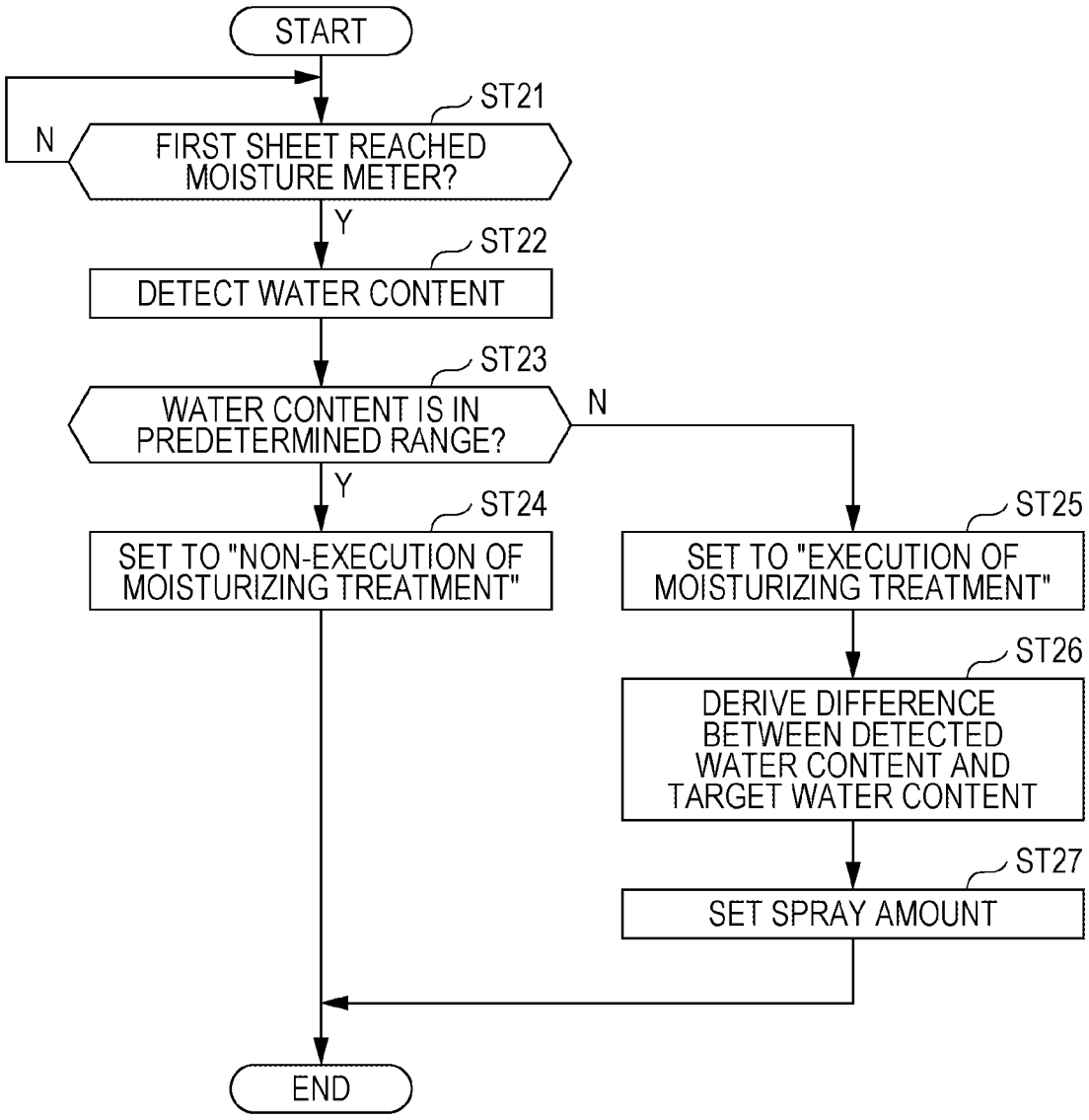
FIG. 5 is flowchart of moisturizing setting processing according to the first exemplary embodiment.

FIG. 5 is flowchart of the moisturizing setting processing according to the first exemplary embodiment.

In step ST21 in FIG. 5, it is determined whether the timing at which a leading end portion of the first recording sheet S reaches the position of the moisture meter SN1 has come. When the determination result is Yes (Y), the process continues to step ST22, and when the determination result is No (N), step ST21 is repeated.

In step ST22, the water content of the recording sheet S is detected, and the process continues to step ST23.

In step ST23, it is determined whether the detected water content is within a predetermined range (6% or higher in the first exemplary embodiment). When the determination result is Yes (Y), the process continues to step ST24, and when the determination result is No (N), the process moves to step ST25.

In step ST24, "non-execution of moisturizing treatment" is set. Then, the process illustrated in FIG. 5 is terminated, and the process returns to step ST3 in FIG. 4.

In step ST25, "execution of moisturizing treatment" is set. Then, the process continues to step ST26.

In step ST26, the difference between the detected water content and the target water content (6%) is derived. Then, the process continues to step ST27.

In step ST27, the spray amount is set in accordance with the difference between the detected water content and the target water content. Then, the process illustrated in FIG. 5 is terminated, and the process returns to step ST3 in FIG. 4.

(Effects of First Exemplary Embodiment)

In the copying machine U according to the first exemplary embodiment, which has the above-described configuration, in the case where one of the recording sheets S that is used when a job is executed is embossed paper or Japanese paper, enabling or disabling of a spray treatment that is performed by the spray device Nb is set. In the first exemplary embodiment, when the water content of embossed paper or the like is lower than 6%, the spray device Nb performs the spray treatment.

Figure 6A:
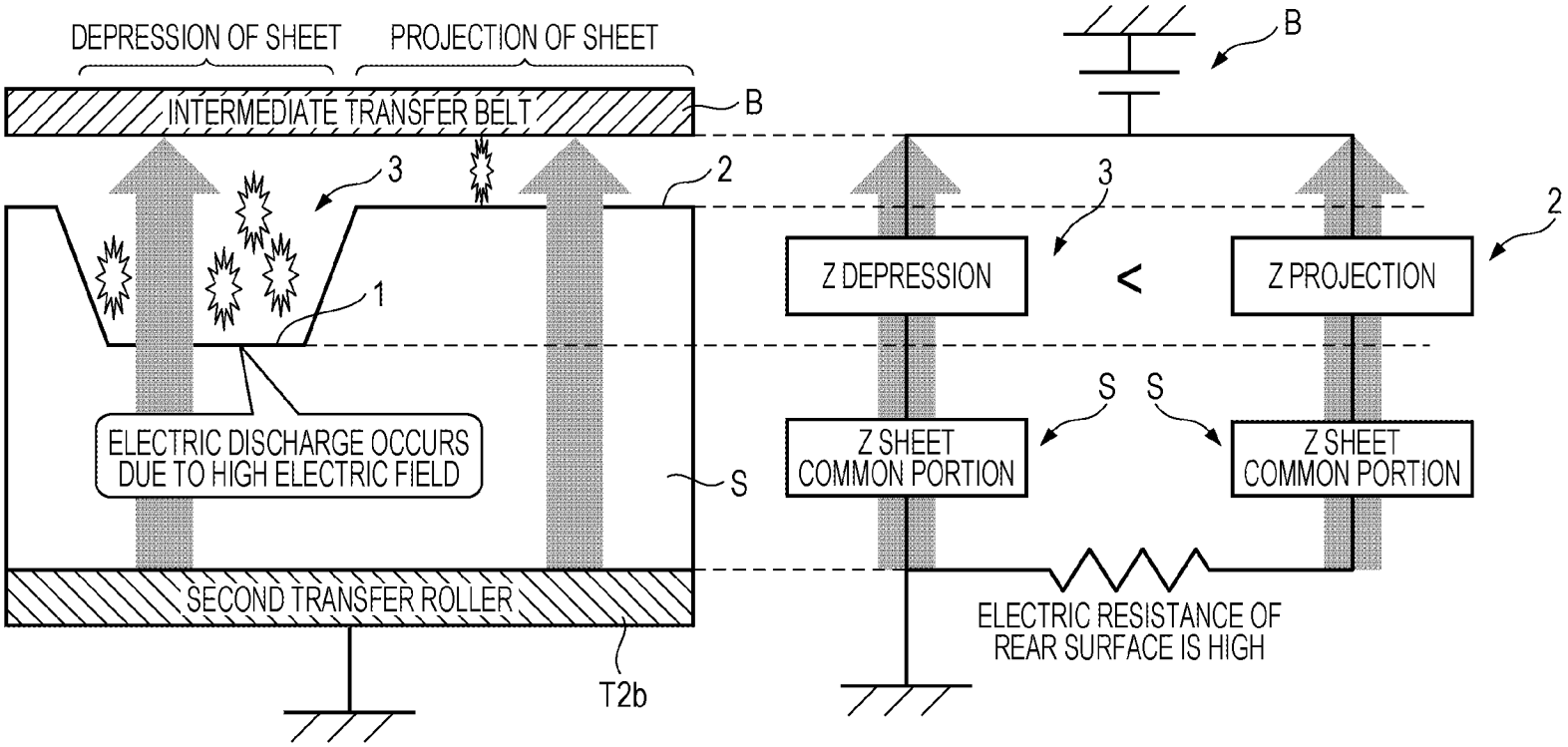
FIGS. 6A and 6B are diagrams illustrating an effect of the first exemplary embodiment, FIG. 6A illustrating a case where the electrical resistance of the rear surface of embossed paper is not reduced, and FIG. 6B illustrating a case where the electrical resistance of the rear surface of embossed paper is reduced.
Figure 6B:
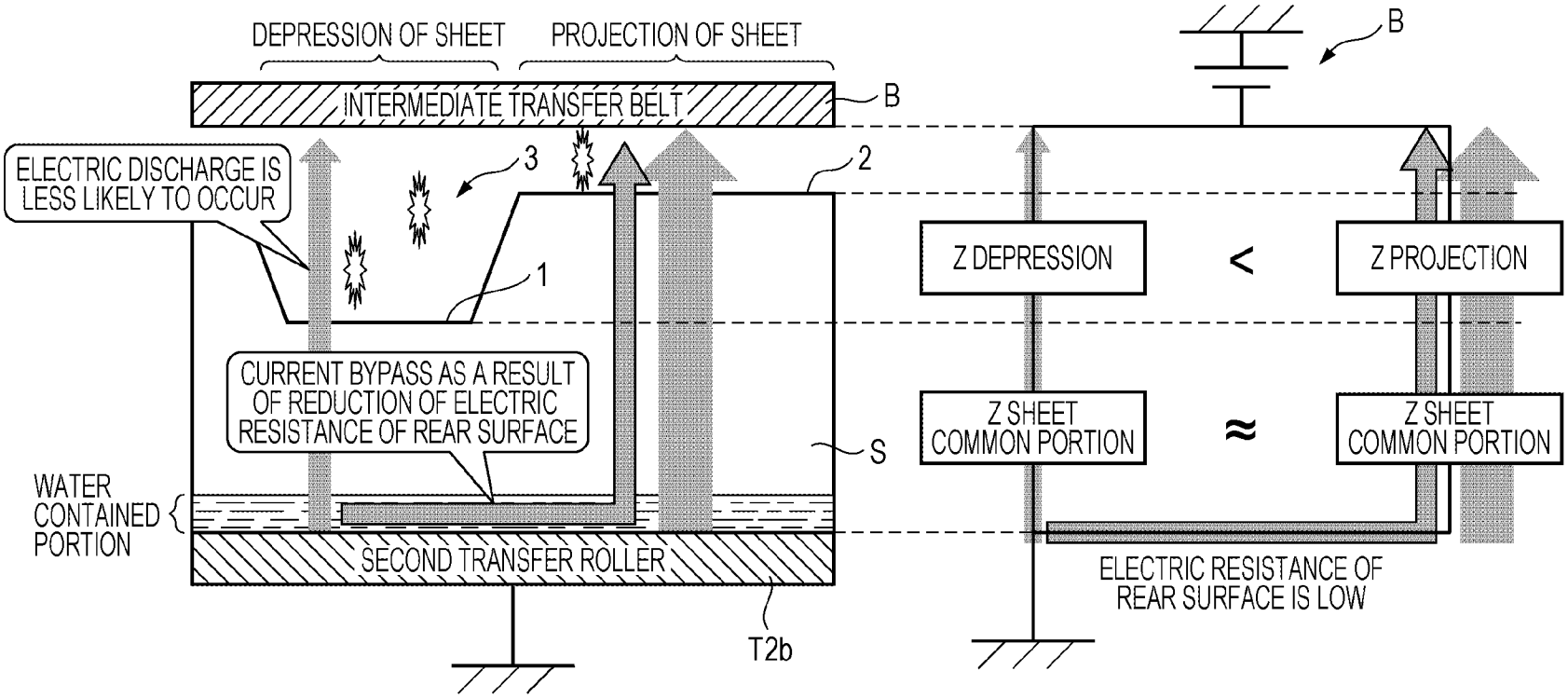

FIGS. 6A and 6B are diagrams illustrating an effect of the first exemplary embodiment. FIG. 6A illustrates a case where the electrical resistance of the rear surface of embossed paper is not reduced, and FIG. 6B illustrates a case where the electrical resistance of the rear surface of embossed paper is reduced.

In FIG. 6A, a plurality of depressions 1 and a plurality of projections 2 are formed on the front surface of the embossed paper, and in the second transfer region Q4, gaps 3 are formed between the depressions 1 and the intermediate transfer belt B. In this state, when the second transfer voltage is applied between the intermediate transfer belt B and the second transfer roller T2*b*, electric discharge is likely to occur in the gaps 3. When electric discharge occurs in the second transfer region Q4, the second transfer voltage decreases, and there is a possibility that a transfer failure will occur. Thus, there is a possibility that the depressions 1 in which electric discharge is likely to occur and the projections 2 in which electric discharge is less likely to occur will cause transfer unevenness, which in turn results in a reduction in image quality.

In contrast, as a result of the spray treatment being performed on the rear surface of one of the recording sheets S as in the first exemplary embodiment, a current easily flows on the rear surface in a surface direction. Thus, as illustrated in FIG. 6B, the current that would flow along the depressions 1 (high electric resistance portions) if the spray treatment is not performed is likely to bypass and flow along the projections 2 (low electric resistance portions) where the gaps 3 are not present. Therefore, occurrence of electric discharge in the gaps 3 is suppressed. As a result, occurrence of a transfer failure in the depressions 1 is suppressed.

Note that the gaps 3 are less likely to be formed in the medium not to be controlled, such as wood-free paper. Consequently, even if the medium has a low water content, a transfer failure may be addressed by adjusting and controlling the second transfer voltage. In addition, in both the case of the medium not to be controlled and the case of the medium to be controlled, when the medium has a high water content, the electrical resistance of the medium is low, and electric discharge is less likely to occur in the second transfer region Q4. Therefore, a transfer failure may be addressed by adjusting and controlling the second transfer voltage.

Figure 7:
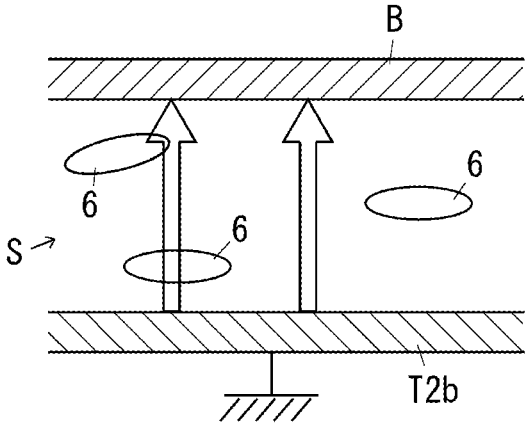
FIG. 7 is a diagram illustrating an effect of the first exemplary embodiment and describing the reason why a transfer failure occurs in Japanese paper.

FIG. 7 is a diagram illustrating an effect of the first exemplary embodiment and describing the reason why a transfer failure occurs in Japanese paper.

As illustrated in FIG. 7, Japanese paper includes fibers thicker or longer than those included in, for example, wood-free paper and is likely to have a large number of pores (gaps) 6 formed therein. Thus, when the second transfer voltage is applied to Japanese paper, electric discharge is likely to occur in the gaps 6, so that a transfer failure is likely to occur.

In contrast, in the first exemplary embodiment, a current is likely to flow on a non-transfer surface of one of the recording sheets S, on which the spray treatment is performed, in the surface direction. Thus, the current is likely to bypass a portion (a high electric resistance portion) where a large number of pores 6 are present and flow through a portion (a low electric resistance portion) where a smaller number of pores 6 are present in the thickness direction of the recording sheet S. Therefore, in the first exemplary embodiment, occurrence of electric discharge in the pores 6 is suppressed, and occurrence of a transfer failure is suppressed.

Examples

FIG. 8 is a table illustrating Examples 1 to 4.

In Example 1, experiments are performed so as to determine whether a transfer failure occurs by changing the water contents of a plurality of sheets. The experiments are performed by using a modified Versant 2100 Press manufactured by Fuji Xerox Co., Ltd.

In Example 1, Leathac 66 (manufactured by Tokushu Tokai Paper Co., Ltd.), which is as an example of embossed paper, is used. Note that the physical properties (basis weight, thickness, density, and so forth) of each paper are based on Japanese Industrial Standard (JIS).

In Example 2, Mermaid snow white (manufactured by Tokushu Tokai Paper Co., Ltd.), which is as an example of embossed paper, is used.

In Example 3, Pansion (manufactured by MOLZA Corporation), which is as an example of Japanese paper, is used.

In Example 4, J paper (manufactured by Fuji Xerox InterField Co., Ltd.), which is as an example of wood-free paper, is used.

Experimental results are illustrated in FIG. 8.

As illustrated in FIG. 8, in Example 4, a transfer failure is relatively unlikely to occur in the wood-free paper having a smooth surface with small surface irregularities even though the water content of the wood-free paper is about 4% as described in Patent Document 3. In general, the water content of an unopened bundle of commercially available sheets is often about 4%, and from this standpoint, there are few problems.

However, it is confirmed from Examples 1 to 3 that a transfer failure is likely to occur in embossed paper and Japanese paper unless each paper has a water content of about 6%.

Note that, in Patent Document 1, a moisturizing treatment and the like is performed on the basis of the environmental temperature, the environmental humidity, the thickness of a recording medium, and the volume resistivity of the recording medium in such a manner as to obtain an optimum transfer voltage. However, as illustrated in FIG. 8, the volume resistivity of embossed paper or the like is approximately the same as that of wood-free paper. In addition, although a transfer failure is less likely to occur in wood-free paper when the wood-free paper has a water content of 4%, a transfer failure is likely to occur in embossed paper or the like when the embossed paper or the like has a water content of 4%. In the technique described in Patent Document 1, control is not changed in accordance with the type of sheet, and a moisturizing treatment is uniformly controlled and performed on all the types of sheets. Thus, in the technique described in Patent Document 1, control that is suitable for wood-free paper, which is frequently used, is generally performed, and in the case where moisturizing control that is suitable for wood-free paper is performed when embossed paper or the like is used, there is a problem in that the water content of the embossed paper or the like is insufficient, so that a transfer failure occurs. Conversely, in Patent Document 1, in the case where moisturizing control that is suitable for embossed paper is performed when wood-free paper is used, there is a possibility that the water content of the wood-free paper will be excessive. As a result, the electrical resistance of the wood-free paper becomes too low, so that a current excessively flows through the second transfer region Q4, and there is also a possibility of a transfer failure.

Note that, also in Patent Documents 2 and 3, control according to the type of sheet is not performed.

In contrast, in the first exemplary embodiment, in the case where embossed paper or the like is used, the spray device Nb moisturizes the embossed paper or the like when the water content of the embossed paper or the like is low.

In addition, in the first exemplary embodiment, an ink jet head is used as the spray device Nb. Consequently, the amount of water that is sprayed onto each of the recording sheets S may be minutely controlled. Therefore, the water content of each of the recording sheets S may be accurately controlled.

Second Exemplary Embodiment

Figure 9:
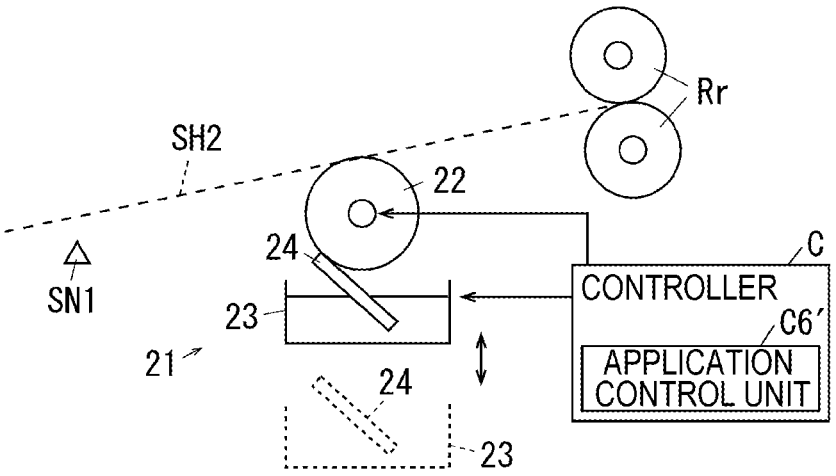
FIG. 9 is a diagram illustrating a reduction unit according to a second exemplary embodiment.

FIG. 9 is a diagram illustrating a reduction unit according to a second exemplary embodiment.

The second exemplary embodiment of the present disclosure will now be described, and in the description of the second exemplary embodiment, components corresponding to the components according to the first exemplary embodiment are denoted by the same reference signs, and detailed descriptions thereof will be omitted.

Differences between the second exemplary embodiment and the first exemplary embodiment are as follows, and the rest of the configuration of the second exemplary embodiment is similar to that of the first exemplary embodiment.

In FIG. 9, in the second exemplary embodiment, an applicator 21, which is an example of a reduction unit and an example of an application unit, is provided instead of the spray device Nb. The applicator 21 according to the second exemplary embodiment includes a contact roller 22 that is an example of a contact member and that is brought into contact with one of the recording sheets S, which is transported. A water tank 23, which is an example of an application-material container, is disposed below the contact roller 22. As an example of an application material, water is contained in the water tank 23. A felt member 24, which is an example of a supply member, is supported on the water tank 23. The felt member 24 is disposed such that a lower portion of the felt member 24 is in contact with the water in the water tank 23 and that an upper end portion of the felt member 24 is capable of making contact with the contact roller 22. The water tank 23 and the felt member 24 are capable of being caused to move up and down in the top-bottom direction by a raising-and-lowering mechanism (not illustrated). Thus, when the felt member 24 is brought into contact with the contact roller 22, the water in the water tank 23 is supplied to a surface of the contact roller 22 via the felt member 24, and when the felt member 24 is separated from the contact roller 22, supply of the water to the surface of the contact roller 22 is stopped.

Note that, in the second exemplary embodiment, although a configuration in which water is supplied has been described as an example, the present disclosure is not limited to this configuration, and as described in the first exemplary embodiment, a configuration may be employed in which an electrically conductive material, such as an electrically conductive ink or an electrically conductive coating material, is applied.

The controller C according to the second exemplary embodiment includes an application control unit C6' instead of the spray control unit C6. When the moisturizing treatment is performed, the application control unit C6' performs controls in such a manner that the water tank 23 and so forth move upward and that the felt member 24 is brought into contact with the contact roller 22. When the moisturizing treatment is not performed, the application control unit C6' performs controls in such a manner that the water tank 23 and so forth move downward and that the felt member 24 is separated from the contact roller 22.

In addition, the application control unit C6' controls the rotational speed of the contact roller 22. Regarding the rotational speed of the contact roller 22, the contact roller 22 is controlled to rotate at a low speed when the difference between a detected water content and a target water content is small, so that the amount of water to be supplied (the amount of water to be applied) is small, and the contact roller 22 is controlled to rotate at a high speed when the difference between a detected water content and a target water content is large, so that the amount of water to be supplied (the amount of water to be applied) is large.

(Effects of Second Exemplary Embodiment)

In the copying machine U according to the second exemplary embodiment, which has the above-described configuration, as in the first exemplary embodiment, in the case where the medium to be controlled, such as embossed paper, is used, the applicator 21 applies water, which is an example of an electrically conductive material, to the medium in accordance with the water content of the medium. In the case where one of the recording sheets S that is used has a high water content, the water tank 23 is caused to separate from the contact roller 22 in such a manner that water is not applied to the recording sheet S. Thus, unlike the non-contact type moisturizing unit of the first exemplary embodiment, the water content of each of the recording sheets S may be adjusted by a contact type moisturizing unit.

In addition, by controlling upward and downward movement of the water tank 23 and by controlling rotation of the contact roller 22, enabling or disabling of supply of water to each of the recording sheets S may be set, and the amount of water to be supplied may be adjusted.

Third Exemplary Embodiment

Figure 10:
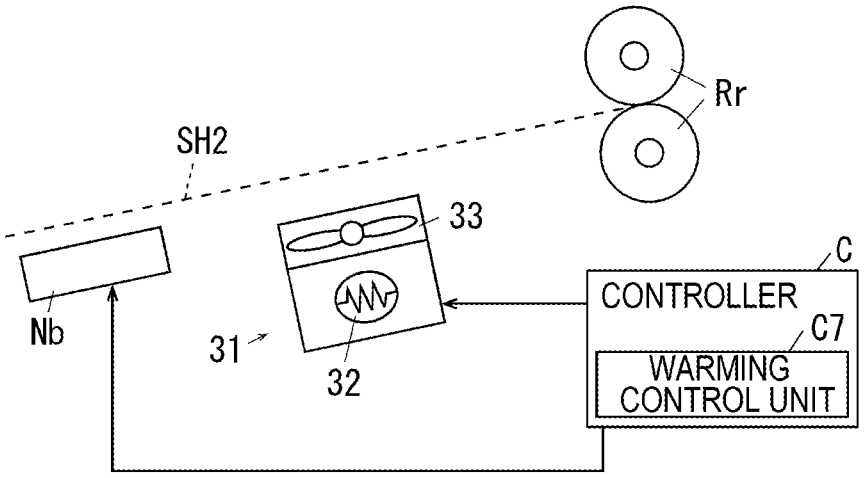
FIG. 10 is a diagram illustrating a reduction unit according to a third exemplary embodiment.

FIG. 10 is a diagram illustrating a reduction unit according to a third exemplary embodiment.

The third exemplary embodiment of the present disclosure will now be described, and in the description of the third exemplary embodiment, components corresponding to the components according to the first exemplary embodiment are denoted by the same reference signs, and detailed descriptions thereof will be omitted.

Differences between the third exemplary embodiment and the first exemplary embodiment are as follows, and the rest of the configuration of the third exemplary embodiment is similar to that of the first exemplary embodiment.

In FIG. 10, in the copying machine U according to the third exemplary embodiment, a warmer 31, which is an example of a reduction unit, is disposed at a position downstream from the spray device Nb of the first exemplary embodiment, so as to face a non-transfer surface of one of the recording sheets S. The warmer 31 includes a heater 32, which is an example of a heat source. A fan 33, which is an example of an air-blowing member, is disposed above the heater 32.

The controller C according to the third exemplary embodiment includes a warming control unit C7 in addition to the units C1 to C6 of the first exemplary embodiment. The warming control unit C7 causes the warmer 31 to operate when the water content of one of the recording sheets S exceeds a predetermined range (6% to 7%). Thus, when the recording sheet S that is used has a water content of higher than 7%, which is an example of a control threshold for a warmer, the warming control unit C7 causes the heater 32 and the fan 33 to operate. Accordingly, warm air is supplied to the recording sheet S, and the recording sheet S is dried, that is, the water content of the recording sheet S is reduced. Note that, in the third exemplary embodiment, when the water content of one of the recording sheets S is lower than 7%, the warming control unit C7 does not cause the warmer 31 to operate.

The warming control unit C7 also controls the temperature of the heater 32 and the rotational speed of the fan 33 (the flow rate of air to be supplied). When the difference between a detected water content and a target water content is small, so that the drying amount is small (the flow rate of the warm air to be supplied is low), the temperature of the heater 32 is controlled to be low, and the fan 33 is controlled to rotate at a low speed. When the difference between a detected water content and a target water content is large, so that the drying amount is large, the temperature of the heater 32 is controlled to be high, and the fan 33 is controlled to rotate at a high speed.

(Effects of Third Exemplary Embodiment)

In the copying machine U according to the third exemplary embodiment, which has the above-described configuration, in the case where the medium to be controlled, such as embossed paper, is used, the medium is moisturized by the spray device Nb or is dried by the warmer 31 in accordance with the water content of the medium. Thus, when the water content of one of the recording sheets S is lower than a predetermined range (6% to 7%), the recording sheet S is moisturized, and when the water content of the recording sheet S is higher than the predetermined range, the recording sheet S is dried. Therefore, the third exemplary embodiment is also useful in the case of a high water content.

(Modifications)

Although the exemplary embodiments of the present disclosure have been described in detail above, the present disclosure is not limited to the above-described exemplary embodiments, and various changes may be made within the scope of the present disclosure as described in the claims. Modifications (H01 to H04) of the present disclosure will be described below as examples.

(H01) In the above-described exemplary embodiments, although the configuration of the copying machine U, which is an example of an image forming apparatus, has been described as an example, the present disclosure is not limited to this configuration and may be applied to a facsimile machine or a multifunction machine or the like having a plurality of functions including a function of a facsimile machine. In addition, the present disclosure is not limited to an image forming apparatus that performs multicolor development, and an image forming apparatus that performs monochromatic development, or specifically black-and-white development, may be used. The present disclosure is not limited to a so-called tandem type image forming apparatus and may be applied to, for example, a rotary type image forming apparatus.

(H02) In the above-described exemplary embodiments, although the configuration that includes the intermediate transfer belt B is likely to be affected by passage of an end portion of one of the recording sheets S, the present disclosure is not limited to this configuration and may be applied to a configuration that does not include the intermediate transfer belt B. In other words, the present disclosure may also be applied to a configuration in which images are directly transferred from the photoconductor drums Py to Pk onto one of the recording sheets S and may also be applied to an image forming apparatus that performs monochromatic development.

(H03) The positions of the spray device Nb, which is an example of a reduction unit, the applicator 21, the warmer 31, and the moisture meter SN1 are not limited to the positions described as examples in the above-described exemplary embodiments. The spray device Nb, the applicator 21, the warmer 31, and the moisture meter SN1 may be disposed at arbitrary positions as long as their positions are further upstream than the second transfer region Q4. Thus, the spray device Nb and so forth may be disposed on the media supply path SH1 of the feeder unit U2 or may be disposed in or on the sheet-feeding trays TR1 to TR4.

(H04) The present disclosure is not limited to the numerical values, the material names, the product names, and so forth that have been mentioned as examples in the above-described exemplary embodiments, and the numerical values, the material names, the product names, and so forth may be changed to those that are available.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding unit that holds a toner image;

a transfer unit that transfers the toner image held by the image holding unit onto a medium in a transfer region;

a reduction unit that is positioned further upstream than the transfer region, facing a first surface of the medium and not facing a second surface of the medium and that reduces an electrical resistance of a first surface of the medium by spraying fluid including electrically conductive material onto the first surface of the medium, the first surface being opposite to the second surface of the medium onto which an image is to be transferred;

a control unit that controls the reduction unit spraying the fluid onto the first surface of the medium in accordance with a type of a medium to be used in such a manner that the electrical resistance of the first surface does not exceed a predetermined range; and a detection unit that detects a water content of a medium, wherein the control unit causes the reduction unit to operate when an electrical resistance that corresponds to a water content detected by the detection unit exceeds the predetermined range, which is predetermined in accordance with the type of the medium.

2. The image forming apparatus according to claim 1, wherein the reduction is formed of a moisturizing unit that moisturizes a medium.

3. The image forming apparatus according to claim 1, wherein the control unit does not cause the reduction unit to operate when a water content does not exceed the predetermined range.

4. The image forming apparatus according to claim 1, wherein the reduction unit is formed of an application unit that applies an electrically conductive material.

5. The image forming apparatus according to claim 2, wherein the reduction unit is formed of an application unit that applies an electrically conductive material.

6. The image forming apparatus according to claim 3, wherein the reduction unit is formed of an application unit that applies an electrically conductive material.

7. An image forming apparatus comprising:

image holding means for holding a toner mage;

transfer means for transferring the toner image held by the image holding means onto a medium in a transfer region;

reduction means, positioned further upstream than the transfer region, facing a first surface of the medium and not facing a second surface of the medium, for reducing an electrical resistance of a first surface of the medium by spraying fluid including electrically conductive material onto the first surface of the medium, the first surface being opposite to the second surface of the medium onto which an image is to be transferred;

control means that controls the reduction means in accordance with a type of a medium to be used in such a manner that the electrical resistance of the first surface spraying the fluid onto the first surface of the medium does not exceed a predetermined range; and detection means that detects a water content of a medium, wherein the control means causes the reduction means to operate when an electrical resistance that corresponds to a water content detected by the detection means exceeds the range, which is predetermined in accordance with the type of the medium.

* * * * *